US005612393A

United States Patent [19]

Arakawa et al.

[11] Patent Number: 5,612,393

[45] Date of Patent: Mar. 18, 1997

[54] CASTING CORE COMPOSITION

[75] Inventors: Takuya Arakawa, Matsusaka; Hiroshi Tako, Fuji; Toru Tohata, Kaminokawa, all of Japan

[73] Assignees: Nissan Motor Co., Ltd., Kanagawa; Aichi Machine Industry Co. Ltd., Aichi, both of Japan

[21] Appl. No.: 639,067

[22] Filed: Apr. 24, 1996

Related U.S. Application Data

[63] Continuation-in-part of Ser. No. 357,008, Dec. 16, 1994, abandoned.

[30] Foreign Application Priority Data

Dec. 24, 1993 [JP] Japan ..... 5-327175

[51] Int. Cl.$^6$ ..... C08K 3/22

[52] U.S. Cl. ..... 523/145; 524/444

[58] Field of Search ..... 523/145; 524/444

[56] References Cited

U.S. PATENT DOCUMENTS

| | | |
|---|---|---|
| 3,616,108 | 10/1971 | Whitehouse et al. . |
| 4,381,355 | 4/1983 | Henry, Jr. et al. . |
| 4,387,173 | 6/1983 | Henry, Jr. et al. . |
| 4,460,730 | 7/1984 | Koyama et al. . |

FOREIGN PATENT DOCUMENTS

| | | |
|---|---|---|
| 940781 | 3/1956 | Germany . |
| 1240231 | 9/1964 | Germany . |
| 838050 | 6/1960 | United Kingdom . |
| 876110 | 8/1961 | United Kingdom . |
| 1380442 | 1/1975 | United Kingdom . |
| 1410634 | 10/1975 | United Kingdom . |
| 1426459 | 2/1976 | United Kingdom . |
| 1492853 | 11/1977 | United Kingdom . |

OTHER PUBLICATIONS

Japanese Industrial Standard, #JIS Z2602, p. 5 (1976).

Perry's Chemical Engineer's Handbook, Sixth Edition, pp. 21–15 (1984).

Product specification for the "Naigai Cerabeads 60", pp. 2–3 (1987).

*Primary Examiner*—Veronica P. Hoke

*Attorney, Agent, or Firm*—Lowe, Price, LeBlanc & Becker

[57] ABSTRACT

The invention relates to a casting core composition including refractory mullite grains and 1.0–2.2 wt % of a phenolic resin for binding the mullite grains. The mullite grains are substantially spherical in shape and have a special grain size distribution. That is, the mullite grains contain first to eighth fractions. These fractions respectively have first to eighth diameters which are respectively within ranges of larger than 420 μm, 297–420 μm 210–297 μm, 149–210 μm, 105–149 μm, 74–105 μm, 53–74 μm, and smaller than 53 μm.

6 Claims, 6 Drawing Sheets

CASTING CORE COMPOSITION

This is a continuation-in-part application of a parent application of Ser. No. 08/357,008 filed Dec. 16, 1994, now abandoned.

BACKGROUND OF THE INVENTION

The present invention relates to a casting core composition, and more particularly to a casting core composition which is to be molded by a so-called shell mold process.

A casting core is used for forming internal cavities in a cast product. In fact, a casting core is inserted between two halves of a mold (cope and drag). Then, a molten metal is poured into the mold. After solidification of the metal, the mold is disassembled and then the cast product is removed. After that, the casting core is broken away and removed from the cast product. With this, the cast product will have internal cavities having certain specific shapes.

Nowadays, many casting cores for automobile cast products are produced by the shell mold process. In this process, the casting core is molded out of a mixture of silica sand grains and a thermosetting resin as a binder for binding the silica sand grains. Silica sand contains $SiO_2$ as a main component thereof. However, if the casting core of this type (silica sand grains bound with a thermosetting resin) is used for casting, for example, an aluminum-alloy automobile cylinder block under a high casting pressure (at least 800 kgf/cm$_2$), it is necessary to provide the casting core with a certain sufficient strength to withstand the high casting pressure. Silica sand grains themselves have variable polygonal shapes. Thus, a casting core prepared from silica sand grains tend to have spaces between silica sand grains, upon molding of the casting core. With this, the casting core may be broken under the high casting pressure. To prevent this, it is considered to increase the amount of the thermosetting resin to, for example, a range of from 3.5 wt % to 4.2% based on the total weight of the silica sand grains and the thermosetting resin. However, with this, percentage of contraction of the casting core's longitudinally center portion in the direction of the thickness thereof becomes large (for example, 15–17%) after casting, and the amount of a so-called deformation of the casting core's center portion also becomes large (for example, 1.2–1.5 mm) after casting (see the aftermentioned Comparative Example 1). With this, the cast product becomes inferior in dimensional precision. The definition of the amount of this deformation will be explained in detail in the following DESCRIPTION OF THE PREFERRED EMBODIMENTS of this application, with reference to FIG. 6.

SUMMARY OF THE INVENTION

It is therefore an object of the present invention to provide an improved casting core composition for providing a casting core with a low percentage of contraction and a small amount of deformation even when the casting core is used in a casting under a high pressure of at least 800 kgf/cm$^2$.

According to a first aspect of the present invention, there is provided a casting core composition comprising:

refractory grains, a majority of said refractory grains comprising mullite grains, said refractory grains being substantially spherical in shape and containing a first fraction having a first diameter larger than 420 μm and a first amount which is 0 wt %, a second fraction having a second diameter within a range of 297–420 μm and a second amount within a range of 0–1.3 wt %, a third fraction having a third diameter within a range of 210–297 μm and a third amount within a range of 0–28.7 wt %, a fourth fraction having a fourth diameter within a range of 149–210 μm and a fourth amount within a range of 3.5–37.6 wt %, a fifth fraction having a fifth diameter within a range of 105–149 μm and a fifth amount within a range of 19.1–70.8 wt %, a sixth fraction having a sixth diameter within a range of 74–105 μm and a sixth amount within a range of 7.8–23.9 wt %, a seventh fraction having a diameter within a range of 53–74 μm and a seventh amount within a range of 0.8–5.5 wt %, and an eighth fraction having an eighth diameter smaller than 53 μm and an eighth amount within a range of 0–0.7 wt %, a first total of said first, second, third, fourth, fifth, sixth, seventh and eighth amounts being 100 wt %; and a phenolic resin for binding said refractory grains, said phenolic resin amounting to a range of from 1.0 to 2.2 wt % based on the total weight of said refractory grains and said phenolic resin, wherein a second total divided by 100 wt % is within a range of 78–110, said second total being a sum of said second amount multiplied by 40, said third amount multiplied by 50, said fourth amount multiplied by 70, said fifth amount multiplied by 100, said sixth amount multiplied by 140, said seventh amount multiplied by 200, and said eighth amount multiplied by 300.

According to a second aspect of the present invention, there is provided a casting core composition comprising:

refractory grains consisting essentially of mullite grains, said refractory grains being substantially spherical in shape and containing a first fraction having a first diameter larger than 420 μm and a first amount which is 0 wt %, a second fraction having a second diameter within a range of 297–420 μm and a second amount within a range of 0–1.3 wt %, a third fraction having a third diameter within a range of 210–297 μm and a third amount within a range of 0–28.7 wt %, a fourth fraction having a fourth diameter within a range of 149–210 μm and a fourth amount within a range of 3.5–37.6 wt %, a fifth fraction having a fifth diameter within a range of 105–149 μm and a fifth amount within a range of 19.1–70.8 wt %, a sixth fraction having a sixth diameter within a range of 74–105 μm and a sixth amount within a range of 7.8–23.9 wt %, a seventh fraction having a diameter within a range of 53–74 μm and a seventh amount within a range of 0.8–5.5 wt %, and an eighth fraction having an eighth diameter smaller than 53 μm and an eighth amount within a range of 0–0.7 wt %, a first total of said first, second, third, fourth, fifth, sixth, seventh and eighth amounts being 100 wt %; and a phenolic resin for binding said refractory grains, said phenolic resin amounting to a range of from 1.0 to 2.2 wt % based on the total weight of said refractory grains and said phenolic resin, wherein a second total divided by 100 wt % is within a range of 78–110, said second total being a sum of said second amount multiplied by 40, said third amount multiplied by 50, said fourth amount multiplied by 70, said fifth amount multiplied by 100, said sixth amount multiplied by 140, said seventh amount multiplied by 200, and said eighth amount multiplied by 300.

According to a third aspect of the present invention, there is provided a casting core composition comprising:

refractory grains, a majority of said refractory grains comprising mullite grains, said refractory grains being substantially spherical in shape and containing a first fraction having a first diameter larger than 425 μm and a first amount which is 0 wt %, a second fraction having a second diameter within a range of 300–425 μm and a second amount within a range of 0–1.3 wt %, a third fraction having a third diameter within a range of 212–300 μm and a third amount within a range of 0–28.7 wt %, a fourth fraction having a fourth diameter within a range of 150–212 μm and a fourth amount within a range of 3.5–37.6 wt %, a fifth fraction having a fifth diameter within a range of 106–150 μm and a fifth amount within a range of 19.1–70.8 wt %, a sixth fraction having a sixth diameter within a range of 75–106 μm and a sixth amount within a range of 7.8–23.9 wt %, a seventh fraction having a diameter within a range of 53–75 and a seventh amount within a range of 0.8–5.5 wt %, and an eighth fraction having an eighth diameter smaller than 53 μm and an eighth amount within a range of 0–0.7 wt %, a first total of said first, second, third, fourth, fifth, sixth, seventh and eighth amounts being 100 wt %; and a phenolic resin for binding said refractory grains, said phenolic resin amounting to a range of from 1.0 to 2.2 wt % based on the total weight of said refractory grains and said phenolic resin, wherein a second total divided by 100 wt % is within a range of 78–110, said second total being a sum of said second amount multiplied by 40, said third amount multiplied by 50, said fourth amount multiplied by 70, said fifth amount multiplied by 100, said sixth amount multiplied by 140, said seventh amount multiplied by 200, and said eighth amount multiplied by 300.

Refractory grains according to the invention are not made up of grains having a uniform size, but are made up of a specifically designed mixture of large and small grains. In other words, as stated above, refractory grains according to the invention always contain the above-mentioned fourth to seventh fractions and may contain the second fraction (up to 1.3 wt %), the third fraction (up to 28.7 wt %), and the eighth fraction (up to 0.7 wt %).

In the invention, the above-mentioned second to eight amounts are such that, when the second to eight amounts are respectively multiplied by 40, 50, 70, 100, 140, 200 and 300, and then when the sum of these multiplications is divided by 100 wt %, the result becomes within a range of from 78 to 100.

DESCRIPTION OF THE PREFERRED EMBODIMENTS

Figure 1:
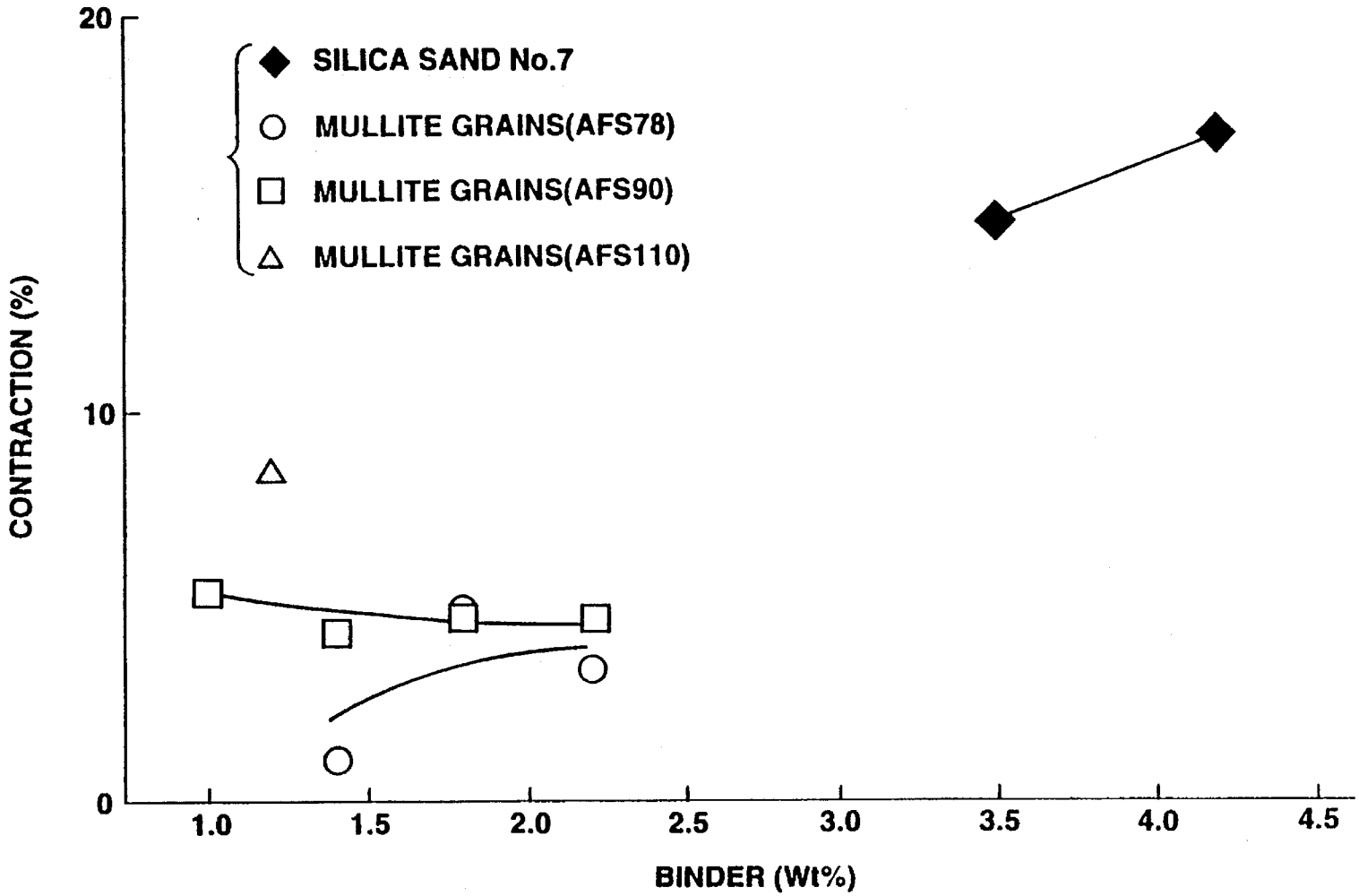
FIG. 1 is a graph illustrating the binder amounts and percentages of contraction of casting cores according to the present invention and conventional casting cores using silica sand grains No. 7, after castings under a pressure of 800 kgf/cm$^2$.

An improved casting core composition according to the present invention will be described in the following. As will be clarified hereinafter, this composition provides a casting core with a low percentage of contraction and a small amount of deformation thereof even when the casting core is used in a casting under a high pressure of at least 800 kgf/cm$^2$. This high pressure casting is very suitable for producing castings which are superior in dimensional precision and surface finish, with a high productivity.

A casting core composition according to the present invention comprises refractory grains and a binder for binding the refractory grains. A majority of the refractory grains comprises mullite grains. The preferable mullite content of the refractory grains is usually at least about 97 wt %. In other words, it is preferable that the refractory grains consist essentially of mullite grains. Therefore, the terms of "the refractory grains" and "the mullite grains" will be used interchangeably hereinafter. Mullite is a mineral having a chemical composition of $3Al_2O_3.2SiO_2$-$2Al_2O_3.SiO_2$. A casting core prepared from the refractory grains according to the present invention is more improved in strength than that prepared from silica sand grains. Therefore, the former casting core does not tend to be broken even upon casting under the high pressure. Furthermore, the former casting core becomes substantially small in contraction after a casting under the high pressure.

According to the present invention, the refractory grains are substantially spherical in shape. This means in the present application that the refractory grains may be somewhat oval in shape, too. With this, the refractory grains become closely packed when a casting core is molded. Therefore, contraction of this casting core is substantially decreased even after a casting under a relatively high pressure.

As will be clarified hereinafter, the refractory grains according to the invention have a special grain size distribution. In other words, the refractory grains are made up of a specifically designed mixture of various fractions from a fine grain size fraction to a coarse grain size fraction. That is, the refractory grains contain a first fraction having a first diameter larger than 420 μm and a first amount which is 0 wt %, a second fraction having a second diameter within a range of 297–420 μm and a second amount within a range of 0–1.3 wt %, a third fraction having a third diameter within a range of 210–297 μm and a third amount within a range of 0–28.7 wt %, a fourth fraction having a fourth diameter within a range of 149–210 μm and a fourth amount within a range of 3.5–37.6 wt %, a fifth fraction having a fifth diameter within a range of 105–149 μm and a fifth amount within a range of 19.1–70.8 wt %, a sixth fraction having a sixth diameter within a range of 74–105 μm and a sixth amount within a range of 7.8–23.9 wt %, a seventh fraction having a diameter within a range of 53–74 μm and a seventh amount within a range of 0.8–5.5 wt %, and an eighth fraction having an eighth diameter smaller than 53 μm and an eighth amount within a range of 0–0.7 wt %.

In the invention, the first amount is 0 wt % as stated above, and the second to eighth amounts are specifically designed so as to meet the following first and second requirements. The first requirement is that a first total of the above-mentioned second, third, fourth, fifth, sixth, seventh and eighth amounts is 100 wt %. The second requirement is that a second total divided by 100 wt % is within a range of from 78 to 110. The second total is defined as a sum of the second amount multiplied by 40, the third amount multiplied by 50, the fourth amount multiplied by 70, the fifth amount multiplied by 100, the sixth amount multiplied by 140, the seventh amount multiplied by 200, and the eighth amount multiplied by 300.

The above-mentioned range of 78–110 corresponds to a range of a grain size distribution index defined by American Foundrymen's Society (AFS). In other words, according to AFS, a grain size distribution index is defined as the following expression:

$$AFS \text{ Grain Size Distr. Index} = \frac{\Sigma(Wn \times AFS \text{ Multiplier})}{\Sigma Wn} \quad (1)$$

wherein Wn represents the weight or the weight percent of each fraction remained on each sieve. Given that Wn represents the weight percentage of each fraction, the summation of each fraction, this summation represented by the term Σ Wn, is 100 wt %.

The numerator of the aforementioned formula multiplies each weight fraction by its respective AFS multiplier. As will be clarified hereinafter, the numbers 40, 50, 70, 140, 200 and 300 are the AFS multiplier for refractory grains according to the invention. As shown in Table 1 which is a partial reproduction of table 21-6 on page 21-15 of the sixth edition of "Perry's Chemical Engineer's Handbook" (1984), an AFS multiplier which is to be multiplied by the weight percent of a certain fraction is defined as the mesh number of the sieve which is coarse or larger, by only one mesh number, than the certain fraction. For example, when the second fraction, 297–420 μm, remains on the sieve or mesh number 50, the AFS multiplier for this fraction is 40, i.e., the sieve number which is coarser or larger by only one mesh number than the second fraction. As another example, when the third fraction (210–297 μm) remains on the sieve or mesh number 70, the AFS multiplier for this fraction is 50 which is the mesh number corresponding to the mesh size of 297 μm.

TABLE 1

| Sieve Designation | | Tyler Equivalent |
|---|---|---|
| Sieve Opening Size (μm) | Mesh Number | Designation (mesh) |
| 420 | 40 | 35 |
| 297 | 50 | 48 |
| 210 | 70 | 65 |
| 149 | 100 | 100 |
| 105 | 140 | 150 |
| 74 | 200 | 200 |
| 53 | 270 | 270 |

According to Japanese Industrial Standard (JIS) Z 2602-1976, the AFS multiplier for a fraction which is smaller than 53 μm and remains on a pan is 300. Therefore, this multiplier of 300 is used in the present application.

Table 2 is a reproduction of a lower table on page 2 of the product specification (1987) for the "NAIGAI CERABEADS 60" (trade name) of NAIGAI CERAMICS CO., LTD. In Table 2, the weight percent of each fraction for each product and AFS grain size distribution index for each product are shown. As will be clarified hereinafter, CERABEADS #750, #1000 and #1450 which are shown in Table 2 were used in the aftermentioned Examples 1–6. As shown in Table 2, for example, CERABEADS #1000 has 0 wt % of a first fraction (>425 μm), 1.3 wt % of a second fraction (425-300 μm), 26.9 wt % of a third fraction (300-212 μm), 30.3 wt % of a fourth fraction (212-150 μm), 19.1 wt % of a fifth fraction (150-106 μm), 16.2 wt % of a sixth fraction (106-75 μm), 5.5 wt % of a seventh fraction (75-53 μm), and 0.7 wt % of an eighth fraction (53 μm >). In Table 2, the total of the first to eighth fractions for each product in weight percent is 100. For example, AFS grain size distribution index for CERABEADS #400 is determined by at first summing up 4.4 wt % multiplied by 30, 74.0 wt % multiplied by 40, 20.8 wt % multiplied by 50, and 0.8 wt % multiplied by 70, and then dividing the result of this summation by 100 wt %. An AFS multiplier of 30 is written on page 5 of JIS Z 2602-1976. As another example, AFS grain size distribution index for CERABEADS #1000 is determined by at first summing up 0 wt % multiplied by 30, 1.3 wt % multiplied by 40, 26.9 wt % multiplied by 50, 30.3 wt % multiplied by 70, 19.1 wt % multiplied by 100, 16.2 wt % multiplied by 140, 5.5 wt % multiplied by 200, and 0.7 wt % multiplied by 300, and then dividing the result of this summation by 100 wt %.

As stated above, refractory grains according to the invention have a special grain size distribution. With this, upon casting, the degree of penetration of a molten metal into the molded casting core becomes small. In other words, the degree of penetration of a molten metal into pores of the molded casting core which are defined between the refractory grains becomes small. Furthermore, it becomes easy to mold a casting core. Still furthermore, upon molding of a casting core, packing density of the refractory grains becomes adequate. With this, the molded casting core does not have void spaces therein. Thus, upon a casting under the high pressure, the degree of contraction and the degree of deformation of the casting core become substantially small.

If the AFS grain size distribution index of the refractory grains is smaller than 78, such as CERABEADS #400, #500 and #650, the proportion of large grains becomes too high. With this, penetration of a molten metal into the molded casting core increases too much upon casting. If the AFS grain size distribution index of the refractory grains is larger than 110, such as CERABEADS #1700, the proportion of small grains becomes too high. With this, it becomes difficult to mold a casting core. Furthermore, upon molding of a casting core, packing density of the refractory grains decreases too much. With this, the molded casting core will have void spaces therein. Thus, upon a casting under the high pressure, contraction and deformation of the casting core become too much.

The amount of the binder is in a range of from 1.0 to 2.2 wt % based on the total weight of the refractory grains and the binder. With this, the casting core becomes adequate in strength. Thus, it becomes easy to completely remove the casting core from the cast product, after the casting. If it is less than 1.0 wt %, it becomes difficult to uniformly mix the refractory grains with the binder. With this, strength of the casting core becomes insufficient. If it is greater than 2.2 wt %, strength of the casting core becomes excessive. With this, it becomes difficult to completely break away and remove the casting core from the cast product, after casting. In the invention, one of thermosetting resins, phenolic resin, is used as the binder.

A casting core is molded out of the casting core composition by a shell mold process such as a so-called dumping shell-mold process or a so-called blowing shell-mold process.

TABLE 2

| Product No. of CERABEADS | Fraction (Mesh Size No.) (Mesh Opening Size (μm)) First Fraction (<36) (>425) | Second Fraction (36–50) (425–300) | Third Fraction (50–70) (300–212) | Fourth Fraction (70–100) (212–150) | Fifth Fraction (100–140) (150–106) | Sixth Fraction (140–200) (106–75) | Seventh Fraction (200–280) (75–53) | Eighth Fraction (280<) (53>) | AFS Grain Size Distr. Index |
|---|---|---|---|---|---|---|---|---|---|
| #400 | 4.4 wt % | 74.0 wt % | 20.8 wt % | 0.8 wt % | — | — | — | — | 41.9 |
| #500 | 6.3 wt % | 37.9 wt % | 25.7 wt % | 22.9 wt % | 6.7 wt % | 0.5 wt % | — | — | 53.3 |
| #650 | — | 0.8 wt % | 38.4 wt % | 50.5 wt % | 10.2 wt % | 0.1 wt % | — | — | 65.2 |
| #750 | — | 0.6 wt % | 28.7 wt % | 37.6 wt % | 24.5 wt % | 7.8 wt % | 0.8 wt % | — | 77.9 |
| #1000 | — | 1.3 wt % | 26.9 wt % | 30.3 wt % | 19.1 wt % | 16.2 wt % | 5.5 wt % | 0.7 wt % | 90.1 |
| #1450 | — | — | — | 3.5 wt % | 70.8 wt % | 23.9 wt % | 1.8 wt % | — | 110.3 |
| #1700 | — | — | — | — | 1.4 wt % | 56.0 wt % | 35.6 wt % | 7.0 wt % | 172.0 |

The present invention will be illustrated with the following nonlimitative examples.

EXAMPLE 1

Three batches of CERABEADS #750 as the spherical mullite grains having an AFS grain size distribution index of 78 (hereinafter, CERABEADS #750 will be referred to as AFS 78) were respectively mixed with 1.4 wt %, 1.8 wt % and 2.2 wt % of a phenolic resin (binder), based on the total weight of AFS 78 and the binder. Separately, four batches of CERABEADS #1000 as the spherical mullite grains having an AFS grain size distribution index of 90 (hereinafter, CERABEADS #1,000 will be referred to as AFS 90) were respectively mixed with 1.0 wt %, 1.4 wt %, 1.8 wt % and 2.2 wt % of a phenolic resin (binder), based on the total weight of AFS 90 and the binder. Still separately, only one batch of CERABEADS #1450 as the spherical mullite sand grains having an AFS grain size distribution index of 110 (hereinafter, CERABEADS #1450 will be referred to as AFS 110) was mixed with 1.2 wt % of a phenolic resin (binder), based on the total weight of AFS 110 and the binder. Then, a casting core for forming a coolant passage (water jacket) of an aluminum alloy cylinder block of an automotive engine was molded out of each of all the above mixtures by a blowing shell mold process. In this process, the blowing pressure for blowing each mixture was controlled within a range from 2.5 to 4.0 kgf/cm$^2$, the curing temperature for curing the phenolic resin was controlled within a range from 180° to 250° C., and the curing time was controlled within a range from 30 to 50 sec.

The thus molded each casting core was inserted into a die casting mold for forming the coolant passage. Then, the cylinder block was cast under a high pressure (800 kgf/cm$^2$). After the casting, each casting core of the cast cylinder block was subjected to a shot blasting, two times each for 40 seconds, so as to break away and remove the casting core from the cast cylinder block.

Percentage of contraction of each casting core's longitudinally center portion in the direction of the thickness thereof was measured. The results are shown in FIG. 1.

Figure 2:
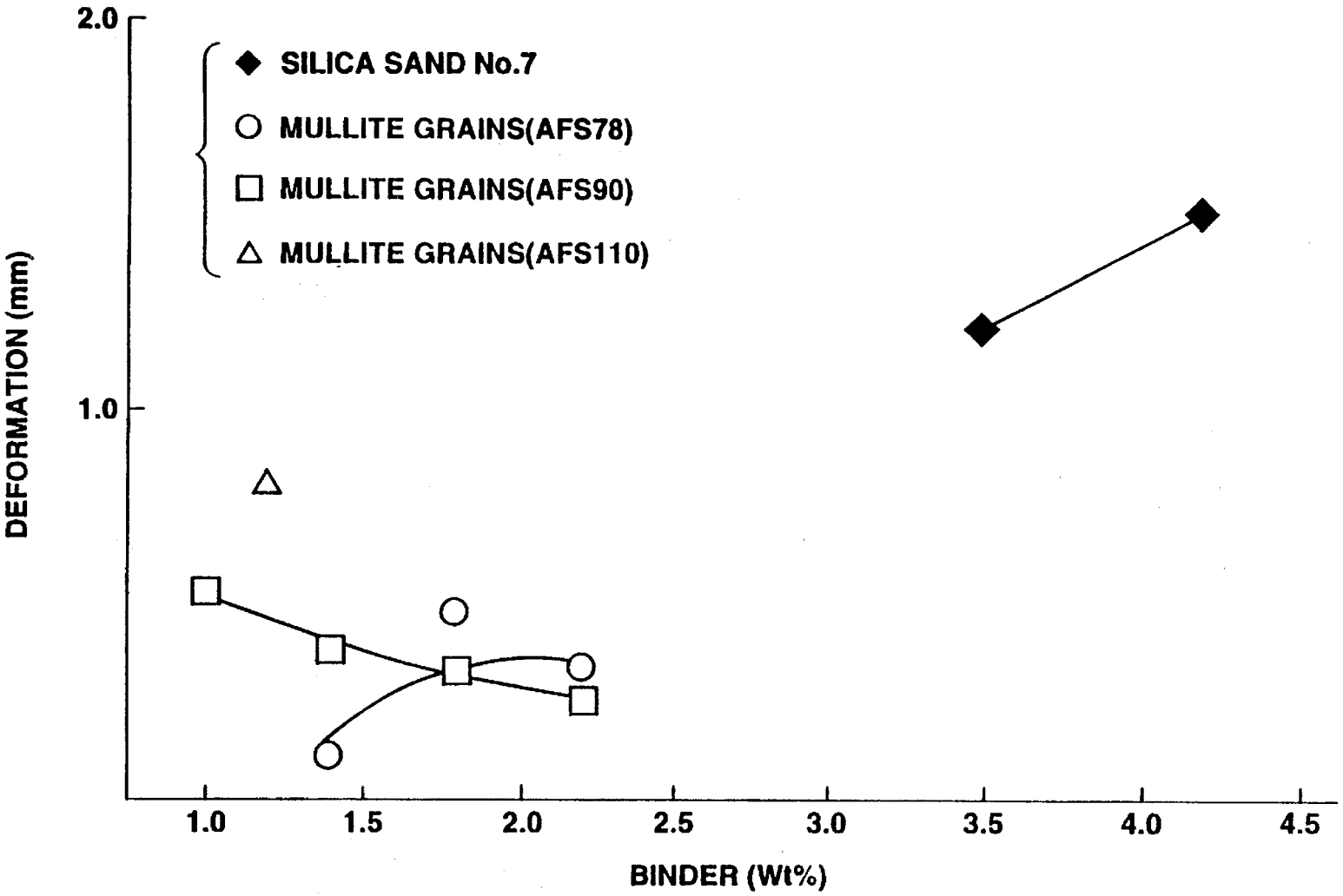
FIG. 2 is a graph similar to FIG. 1, but illustrating the binder amounts and the amounts of deformation of casting cores according to the present invention and conventional casting cores using silica sand grains No. 7, after castings under a pressure of 800 kgf/cm$^2$.
Figure 6:
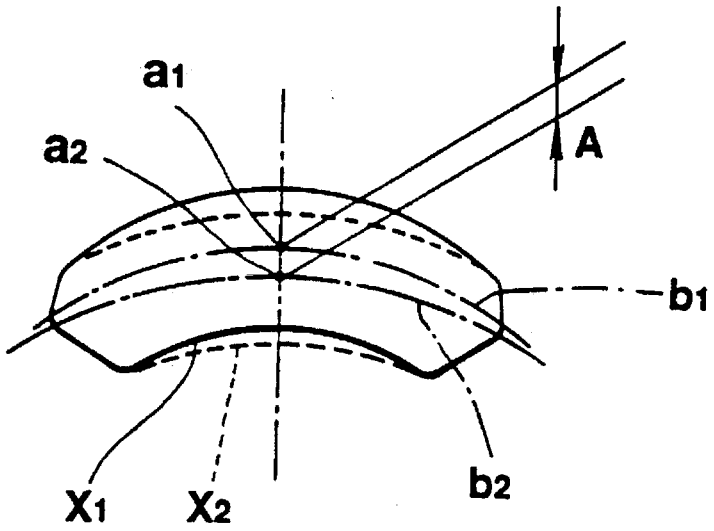
FIG. 6 is a schematic plan view showing by a solid line a casting core before casting, and by a dotted line a deformed casting core after a casting under a high pressure.

The amount of deformation of each casting core's longitudinally center portion was measured. The results are shown in FIG. 2. The definition of the amount of deformation of each casting core will be described in the following, with reference to FIG. 6. FIG. 6 is a schematic plan view showing by a solid line X1 a casting core before a casting under a high pressure, and by a dotted line X2 a deformed casting core after a casting under a high pressure. That is, a curved casting core before casting tends to deform and become straight after a casting under a high pressure. The amount of deformation is defined as the distance between a1 which is a center point of a casting core before casting and a2 which is a center point of a deformed casting core after casting. A line b 1 is a center line of a casting core before casting, which is defined in the longitudinal direction thereof. A line b2 is a center line of a casting core after casting, which is defined in the longitudinal direction thereof. As is shown in FIG. 6, the points "a1" and "a2" are on a center line of a casting, which is defined in the direction of the casting core's width.

Figure 5:
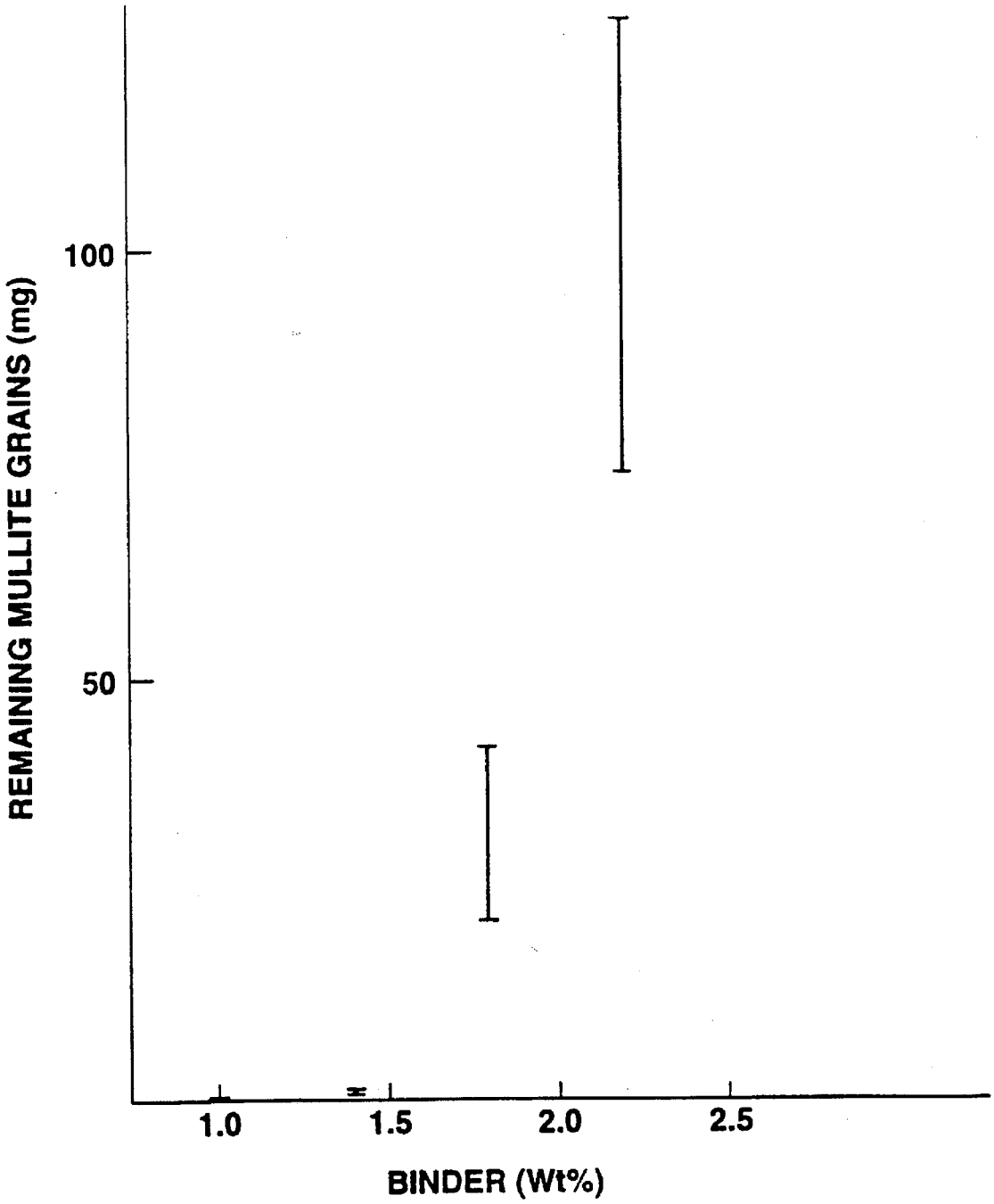
FIG. 5 is a graph illustrating the binder amounts and the amounts of the mullite grains remained in each internal cavity of a cast product, after a casting under a pressure of 800 kgf/cm$^2$ and then shot blasting.

The amount of the mullite grains remained in each internal cavity of the cylinder block was determined. The results are shown in FIG. 5. In FIG. 5, the upper and lower ends of a line segment at each binder amount (1.0, 1.4, 1.8 or 2.2 wt %) respectively represent the maximum and minimum mullite grains' amounts remained in each internal cavity of the cylinder block at each binder amount. It should be noted that the amount of the remained mullite grains is not influenced by the pressure variation of casting. Therefore, the amount of the mullite grains remained in each internal cavity of the cylinder block was determined only for the casting cores after the casting under a pressure of 800 kgf/cm$^2$. In other words, the determination of the amount of the remained mullite grains was not conducted in the following Examples 2–6 and Comparative Examples 1–3.

EXAMPLES 2–6

In each of Examples 2–6, Example 1 was repeated except that a plurality of batches of only AFS 90 were respectively mixed with 1.0 wt %, 1.4 wt %, 1.8 wt % and 2.2 wt % of a phenolic resin (binder), based on the total weight of AFS 90 and the binder, and that each cylinder block was cast under a pressure of 500, 600, 700, 900 or 1,000 kgf/m$^2$.

Figure 3:
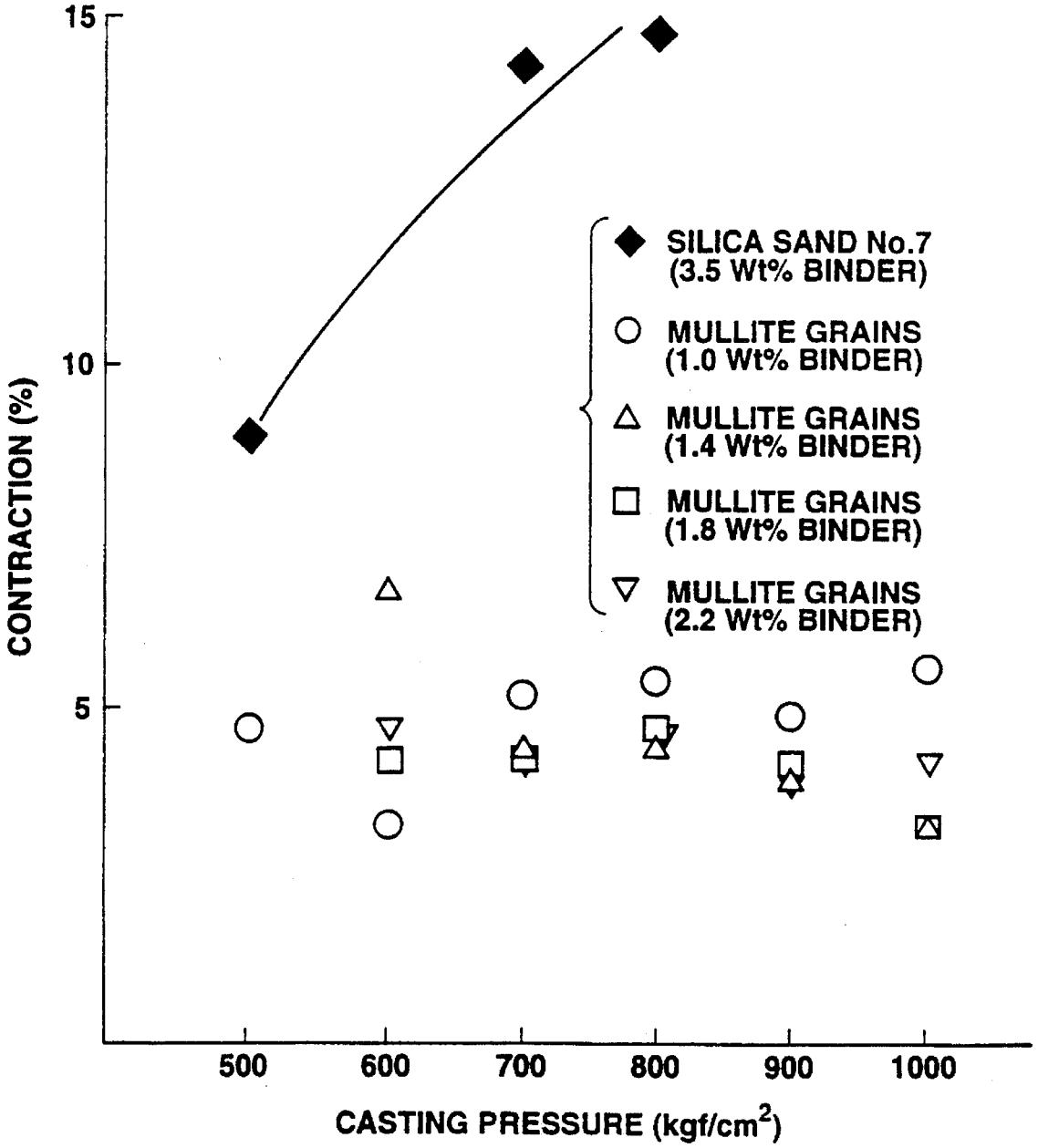
FIG. 3 is a graph illustrating the casting pressures and percentages of contraction of casting cores according to the present invention and conventional casting cores using silica sand grains No. 7, after castings.
Figure 4:
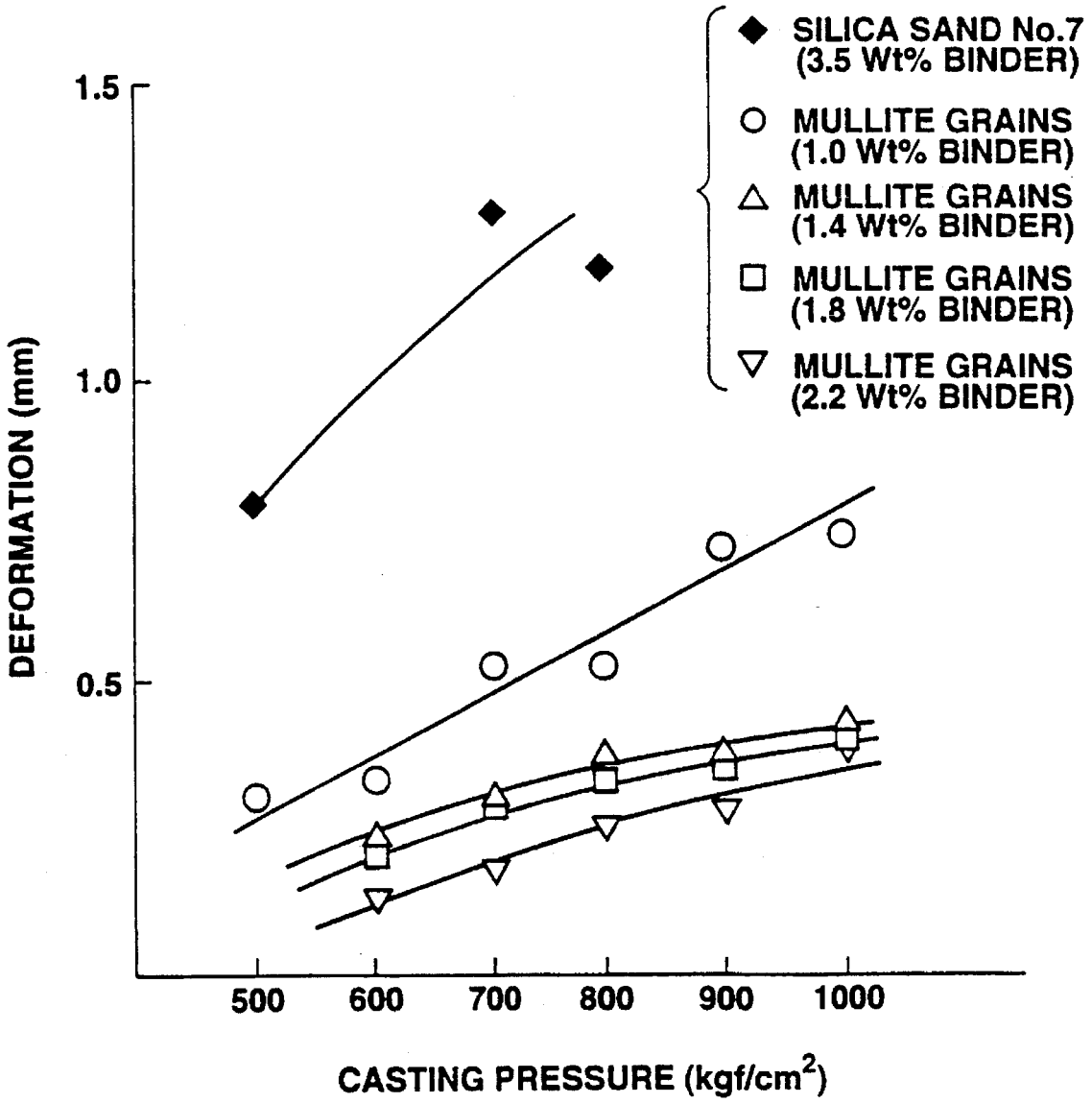
FIG. 4 is a graph similar to FIG. 3, but illustrating the casting pressures and the amounts of deformation of casting cores according to the present invention and conventional casting cores using silica sand grains No. 7, after castings.

The results regarding the above-defined percentage of contraction and the amount of deformation of each casting core are respectively shown in FIGS. 3 and 4. Thus, it should be noted that all the data shown in FIGS. 3 and 4 are concerned with each casting core prepared from a mixture of AFS 90 and the binder. Furthermore, it should be noted that all the data regarding. AFS 90 after a casting under a pressure of 800 kgf/m$^2$ shown in FIGS. 1 and 2 are respectively copied as the data after a casting under a pressure of 800 kgf/m$^2$ shown in FIGS. 3 and 4.

COMPARATIVE EXAMPLE 1

In this Comparative Example 1, Example 1 was repeated except that only two batches of silica sand grains No. 7 were respectively mixed with 3.5 wt % and 4.2 wt % of a phenolic resin (binder), based on the total weight of the silica sand grains No. 7 and the binder, and that the shot blasting of Example 1 was omitted.

The results regarding the above-defined percentage of contraction and the amount of deformation are respectively shown in FIGS. 1 and 2. Furthermore, the results regarding the above-defined percentage of contraction and the amount of deformation of the casting core prepared by using the mixture of silica sand grains No. 7 and 3.5 wt % of the phenolic resin are also shown in FIGS. 3 and 4 (see the data at a casting pressure of 800 kgf/cm$^2$ in FIGS. 3 and 4).

The reason why the binder amounts of Comparative Examples 1–3 (3.5 and/or 4.2 wt %) are different from those of Examples 1–6 (1.0–2.2 wt %) will be discussed in the following. If 1.0–2.2 wt % of the binder Were used in Comparative Examples 1–3, it is expected that the percentage of contraction and the amount of deformation would become much higher than those shown in FIGS. 1–4. With this, it becomes difficult to neatly show the data of Comparative Example 1–3 and the data of Examples 1–6 in one graph. Therefore, in Comparative Examples 1–3, 3.5 and 4.2 wt % were chosen, instead of 1.0–2.2 wt %.

COMPARATIVE EXAMPLES 2–3

In each of Comparative Examples 2–3, Example 1 was repeated except that only two batches of silica sand grains No. 7 were respectively mixed with 3.5 wt % of a phenolic resin, that the cylinder blocks were respectively cast under pressures of 500 and 700 kgf/m$^2$, and that the shot blasting of Example 1 was omitted. The results regarding the above-defined percentage of contraction and the amount of deformation of each casting core are respectively shown in FIGS. 3 and 4.

It is understood from FIGS. 1 and 2 that the percentage of contraction and the amount of deformation of each casting core according to Comparative Example 1 were respectively much greater than those according to Example 1. Furthermore, it is understood from FIGS. 1 and 2 that there are tendencies that the percentage of contraction and the amount of deformation respectively increase as the grain size of the mullite grains becomes finer. In comparison between AFS 78, AFS 90 and AFS 110, AFS 78, AFS 90 and AFS 110 are respectively coarse, medium, and fine in terms of grain size distribution as shown in Table 2.

With reference to FIGS. 3 and 4, it is understood that the percentage of contraction and the amount of deformation of each casting core according to Comparative Examples 1–3 were respectively much greater than those according to Examples 1–6, throughout the range of casting pressure (500–1,000 kgf/cm$^2$). Furthermore, with reference to FIGS. 3 and 4, it is understood that the percentage of contraction and the amount of deformation of each casting core according to Comparative Examples 1–3 respectively increased more steeply by increasing the casting pressure, as compared with those according to Examples 1–6. It is understood from FIG. 4 that there is a tendency that the amount of deformation of the casting core according to Examples 1–6 increases as the amount of binder becomes smaller.

With reference to FIG. 5, it is understood that the amount of the mullite grains remained in each internal cavity of the cylinder block, after a casting under a pressure of 800 kgf/cm$^2$, increases by increasing the amount of binder. The reason of this is considered that strength of the casting core increases by increasing the amount of binder.

What is claimed is:

1. A casting core composition comprising:

refractory grains, a majority of said refractory grains comprising mullite grains, said refractory grains being substantially spherical in shape and containing a first fraction having a first diameter larger than 420 μm and a first amount which is 0 wt %, a second fraction having a second diameter within a range of 297–420 μm and a second amount within a range of 0–1.3 wt %, a third fraction having a third diameter within a range of 210–297 μm and a third amount within a range of 0–28.7 wt %, a fourth fraction having a fourth diameter within a range of 149–210 μm and a fourth amount within a range of 3.5–37.6 wt %, a fifth fraction having a fifth diameter within a range of 105–149 μm and a fifth amount within a range of 19.1–70.8 wt %, a sixth fraction having a sixth diameter within a range of 74–105 μm and a sixth amount within a range of 7.8–23.9 wt %, a seventh fraction having a diameter within a range of 53–74 μm and a seventh amount within a range of 0.8–5.5 wt %, and an eighth fraction having an eighth diameter smaller than 53 μm and an eighth amount within a range of 0–0.7 wt %, a first total of said first, second, third, fourth, fifth, sixth, seventh and eighth amounts being 100 wt %; and a phenolic resin for binding said refractory grains, said phenolic resin amounting to a range of from 1.0 to 2.2 wt % based on the total weight of said refractory grains and said phenolic resin, wherein a second total divided by 100 wt % is within a range of 78–110, said second total being a sum of said second amount multiplied by 40, said third amount multiplied by 50, said fourth amount multiplied by 70, said fifth amount multiplied by 100, said sixth amount multiplied by 140, said seventh amount multiplied by 200, and said eighth amount multiplied by 300.

2. A casting core made from the composition of claim 1.

3. A casting core composition comprising:

refractory grains consisting essentially of mullite grains, said refractory grains being substantially spherical in shape and containing a first fraction having a first diameter larger than 420 μm and a first amount which is 0 wt %, a second fraction having a second diameter within a range of 297–420 μm and a second amount within a range of 0–1.3 wt %, a third fraction having a third diameter within a range of 210–297 μm and a third amount within a range of 0–28.7 wt %, a fourth fraction having a fourth diameter within a range of 149–210 μm and a fourth amount within a range of 3.5–37.6 wt %, a fifth fraction having a fifth diameter within a range of 105–149 μm and a fifth amount within a range of 19.1–70.8 wt %, a sixth fraction having a sixth diameter within a range of 74–105 μm and a sixth amount within a range of 7.8–23.9 wt %, a seventh fraction having a diameter within a range of 53–74 μm and a seventh amount within a range of 0.8–5.5 wt %, and an eighth fraction having an eighth diameter smaller than 53 μm and an eighth amount within a range of 0–0.7 wt %, a first total of said first, second, third, fourth, fifth, sixth, seventh and eighth amounts being 100 wt %; and a phenolic resin for binding said refractory grains, said phenolic resin amounting to a range of from 1.0 to 2.2 wt % based on the total weight of said refractory grains and said phenolic resin, wherein a second total divided by 100 wt % is within a range of 78–110, said second total being a sum of said second amount multiplied by 40, said third amount multiplied by 50, said fourth amount multiplied by 70, said fifth amount multiplied by 100, said sixth amount multiplied by 140, said seventh amount multiplied by 200, and said eighth amount multiplied by 300.

4. A casting core made from the composition of claim 3.

5. A casting core composition comprising:

refractory grains, a majority of said refractory grains comprising mullite grains, said refractory grains being substantially spherical in shape and containing a first fraction having a first diameter larger than 425 μm and a first amount which is 0 wt %, a second fraction having a second diameter within a range of 300–425 μm and a second amount within a range of 0–1.3 wt %, a third fraction having a third diameter within a range of 212–300 μm and a third amount within a range of 0–28.7 wt %, a fourth fraction having a fourth diameter within a range of 150–212 μm and a fourth amount within a range of 3.5–37.6 wt %, a fifth fraction having a fifth diameter within a range of 106–150 μm and a fifth amount within a range of 19.1–70.8 wt %, a sixth fraction having a sixth diameter within a range of 75–106 μm and a sixth amount within a range of 7.8–23.9 wt %, a seventh fraction having a diameter within a range of 53–75 μm and a seventh amount within a range of 0.8–5.5 wt %, and an eighth fraction having an eighth diameter smaller than 53 μm and an eighth amount within a range of 0–0.7 wt %, a first total of said first, second, third, fourth, fifth, sixth, seventh and eighth amounts being 100 wt %; and a phenolic resin for binding said refractory grains, said phenolic resin amounting to a range of from 1.0 to 2.2 wt % based on the total weight of said refractory grains and said phenolic resin, wherein a second total divided by 100 wt % is within a range of 78–110, said second total being a sum of said second amount multiplied by 40, said third amount multiplied by 50, said fourth amount multiplied by 70, said fifth amount multiplied by 100, said sixth amount multiplied by 140, said seventh amount multiplied by 200, and said eighth amount multiplied by 300.

6. A casting core made from the composition of claim 5.

* * * * *